US011608698B2

(12) United States Patent
Kellner et al.

(10) Patent No.: US 11,608,698 B2
(45) Date of Patent: Mar. 21, 2023

(54) DOWNHOLE TOOL SECURABLE IN A TUBULAR STRING

(71) Applicant: INNOVEX DOWNHOLE SOLUTIONS, INC., Houston, TX (US)

(72) Inventors: Justin Kellner, Adkins, TX (US); Tyler Tinnin, Cypress, TX (US); Bennett Griffith, III, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 22 days.

(21) Appl. No.: 17/220,987

(22) Filed: Apr. 2, 2021

(65) Prior Publication Data

US 2021/0222504 A1 Jul. 22, 2021

Related U.S. Application Data

(63) Continuation-in-part of application No. 16/517,194, filed on Jul. 19, 2019, now Pat. No. 11,346,179.

(51) Int. Cl.
*E21B 23/00* (2006.01)
*E21B 34/06* (2006.01)
(Continued)

(52) U.S. Cl.
CPC ..... *E21B 23/00* (2013.01); *E21B 34/06* (2013.01); *E21B 34/142* (2020.05); *E21B 33/00* (2013.01); *E21B 33/14* (2013.01); *E21B 34/08* (2013.01); *E21B 2200/05* (2020.05); *E21B 2200/06* (2020.05)

(58) Field of Classification Search
CPC ..... E21B 33/16; E21B 33/165; E21B 33/167; E21B 33/14; E21B 23/01; E21B 34/10; E21B 34/06; E21B 21/10–106; E21B 21/00; E21B 23/00; E21B 34/08; E21B 34/142; E21B 34/14; E21B 2200/05; E21B 2200/06; E21B 33/00; F16K 27/00;
(Continued)

(56) References Cited

U.S. PATENT DOCUMENTS 5,472,053 A * 12/1995 Sullaway ..... E21B 34/06 166/327
5,909,771 A * 6/1999 Giroux ..... E21B 21/10 166/212
(Continued)

FOREIGN PATENT DOCUMENTS

WO 2017124977 A1 7/2017

OTHER PUBLICATIONS

Baker-Hughes, Float Equipment Insert for Product Family No. H26668; Product Family No. H26656; Product Family No. H26664; Product Family No. H26659; Product Family No. H26662; and Product Family No. H26660, p. 81.
(Continued)

*Primary Examiner* — George S Gray
(74) *Attorney, Agent, or Firm* — MH2 Technology Law Group LLP

(57) ABSTRACT

A downhole tool includes a tubular, an inner valve assembly positioned in the tubular, and a body positioned radially between the inner valve assembly and the tubular, the body at least partially made from a bonding agent configured to secure the inner valve assembly in the tubular.

22 Claims, 9 Drawing Sheets

(51) Int. Cl.

| | |
|---|---|
| ***E21B 34/14*** | (2006.01) |
| *E21B 33/00* | (2006.01) |
| *E21B 33/14* | (2006.01) |
| *E21B 34/08* | (2006.01) |

(58) Field of Classification Search
CPC ..... F16K 27/02–0209; F16K 27/0227; F16K 27/0245; F16K 27/0254
See application file for complete search history.

(56) References Cited

U.S. PATENT DOCUMENTS

| | | | | |
|---|---|---|---|---|
| 2002/0148615 | A1* | 10/2002 | Szarka | E21B 34/14 166/332.4 |
| 2014/0216742 | A1* | 8/2014 | Darbe | E21B 33/14 166/285 |
| 2017/0292338 | A1* | 10/2017 | Downey | E21B 23/00 |
| 2021/0172287 | A1* | 6/2021 | Gan | E21B 37/10 |

OTHER PUBLICATIONS

Tai Wook Park, International Search Report and Written Opinion dated Jul. 11, 2022, PCT Application No. PCT/US2022/072462, 11 pages.

* cited by examiner

DOWNHOLE TOOL SECURABLE IN A TUBULAR STRING

CROSS-REFERENCE TO RELATED APPLICATIONS

The present application is a continuation-in-part of U.S. patent application having Ser. No. 16/517,194, which was filed on Jul. 19, 2019 and is incorporated herein by reference in its entirety.

BACKGROUND

In the oil and gas industry, a variety of tools have been developed to be run into a wellbore and support various operations. These are often referred to as "downhole tools." Float equipment is one type of downhole tool, and generally is used to support completion operations. For example, a float shoe may be secured to a lower end of a casing string to provide a check valve function that prevents fluid in the wellbore from entering the interior of the casing as the casing proceeds into the wellbore. Float shoes may also be used to prevent reverse flow ("U-tubing") of cement slurry back into the casing during cementing operations. Similarly, float collars may also include check valves and may also be used to prevent such well-fluid ingress and U-tubing, e.g., in combination with float joints. Other downhole tools may include plugs, sleeves, valves, etc.

In some situations, casing strings (and/or other oilfield tubular strings) may require premium threads for connections between adjacent pipe joints. Premium threads may have small tolerances, special shapes, or both, and thus may require expensive and time-consuming thread-forming operations. Thus, to couple the float equipment (or other types of downhole tools) to the strings that include premium threads, the tools also typically require premium threads, increasing the cost and potentially extending the delivery time of the float equipment. This situation may be further complicated when different casing sizes, different weights, etc. are used, which can result in a need to store or make many, differently-sized tools to support completion operations for a single well, let alone many wells.

SUMMARY

Embodiments of the disclosure may provide a downhole tool including a tubular, an inner valve assembly positioned in the tubular, and a body positioned radially between the inner valve assembly and the tubular, the body at least partially made from a bonding agent configured to secure the inner valve assembly in the tubular.

Embodiments of the disclosure may also provide a method including positioning an inner valve assembly in a tubular, injecting a bonding agent into an annular region formed radially between the inner valve assembly and the tubular, to form an outer body that secures the inner valve assembly in the tubular, connecting the tubular to a string of oilfield tubulars, and deploying the inner valve assembly, the tubular, and the string into a well.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
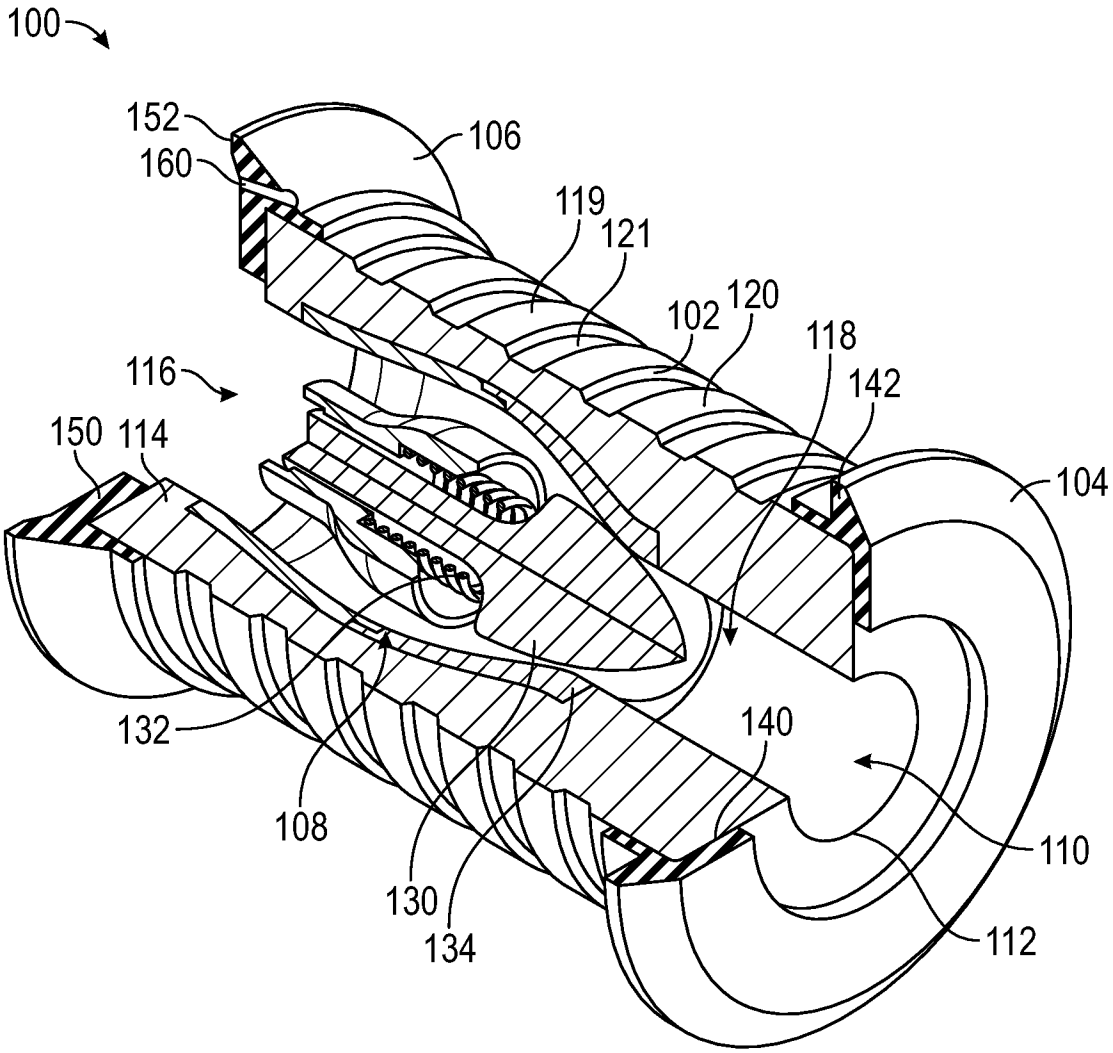
FIG. 1 illustrates a perspective, quarter-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective, quarter-sectional view of a downhole tool 100, according to an embodiment. The downhole tool 100 may include a generally-cylindrical body 102, a first seal 104, a second seal 106, and an inner valve assembly, e.g., a float valve assembly 108. While the illustrated downhole tool 100 is discussed and described herein generally in the context of a float valve (e.g., a float shoe or float collar) having such a float valve assembly 108, it will be appreciated that the downhole tool 100 could be a latch valve, any other type of valve, a frac sleeve, or any other type of tool configured to be run into a wellbore as part of a string of tubulars (e.g., casing, drill pipe, etc.), and as such, may include different types of equipment.

The body 102 may be formed at least partially from cement, epoxy, or another solid, e.g., castable, material, as will be described in greater detail below. The body 102 may thus be referred to herein as a "cement body," with it being appreciated that this connotes at least partial (e.g., about half, a majority, or an entire) formation by cement. The cement used for the body 102 may be any formulation suitable for the intended use, including any suitable hardeners and/or reinforcement (e.g., fibers, steel), etc. The body 102 may also define a bore 110, which may extend axially therein, e.g., entirely between a first axial end 112 of the body 102 and a second axial end 114 thereof. In some embodiments, the bore 110 may include a radially larger portion 116, in which the float valve assembly 108 is positioned, and a radially smaller portion 118 extending from the larger portion 116 and allowing fluid communication with the float valve assembly 108.

An outer diameter surface 119 may extend axially between the first and second axial ends 112, 114 of the body 102, with the body 102 being defined radially between the outer diameter surface 119 and the bore 110. Further, ridges 120 and grooves 121 may be defined in the outer diameter surface 119. For example, the ridges 120 may extend radially outwards with respect to the grooves 121, which may be situated between axially-adjacent ridges 120. Further, the ridges 120 and grooves 121 may extend circumferentially, as shown, entirely around the body 102, but in other embodiments may extend partially around the body 102 and/or in other directions (e.g., partially axially, zig-zag, etc.).

In some embodiments, the float valve assembly 108 may include a valve element 130, a valve seat 132, and a biasing member 134. The valve element 130 may be biased by the biasing member 134 toward the valve seat 132, so as to obstruct (e.g., prevent) fluid flow axially through the bore 110, e.g., from the second axial end 114 to the first axial end 112, while allowing fluid flow axially through the bore 110 from the first axial end 112 to the second axial end 114. Again, it is emphasized that different embodiments may include different valves, valve assemblies, sleeves, or other equipment positioned in the body 102, depending on the intended use of the downhole tool 100.

The first and second seals 104, 106 may be secured to the body 102 and may extend radially outwards therefrom. In a specific embodiment, the seals 104, 106 may be generally blade or "fin" shaped, such that an outer edge thereof is configured to slide against a surrounding tubular and form a fluid-tight seal therewith. The first and second seals 104, 106 may thus be referred to herein as seals or "fins" for purposes of illustration and without limitation. The first and second seals 104, 106 may be axially offset from one another, e.g., positioned proximal to the opposite axial ends 112, 114 of the body 102. The first and second seals 104, 106 may be made from a polymer, elastomer, or another material suitable for engaging and sealing with a surrounding tubular. For example, the first and second seals 104, 106 may be made at least partially from rubber or urethane.

Further, the first and second seals 104, 106 may be bonded to the body 102, e.g., using a bonding agent such as epoxy. The first seal 104 may include an L-shaped connecting portion 140, and a tapered portion 142 extending outward therefrom. The L-shaped connection portion 140 may be bonded to the first axial end 112 and to the outer diameter surface 119. The tapered portion 142 may be oriented to extend toward the second end 114, which may facilitate sliding the tool 100 into a surrounding tubular, with the first end 112 preceding the second end 114. Further, the tapered portion 142 may be configured to deflect so as to increase or decrease its radial outer-most extent, e.g., depending on the size of the tubular into which it is received, as will be described in greater detail below. It will be appreciated that the body 102 and seals 104, 106 may be configured to slide into a surrounding tubular in either direction.

The second seal 106 may similarly include an L-shaped connection portion 150 and a tapered portion 152. The L-shaped connection portion 150 may be configured to be bonded to the second end 114 and the outer diameter surface 119 of the body 102. The tapered portion 152 may extend away from the second end 114, away from the body 102, so as to support sliding the tool 100 into the surrounding tubular with the first end 112 preceding the second end 114. The tapered portion 152 may be configured to deflect to engage surrounding tubulars of a range of different inner diameters.

The second seal 106 may also optionally include an injection port 160. In some embodiments, the first seal 104 may instead or additionally include the injection port 160 or another injection port, e.g., in addition to the injection port 160. In the illustrated embodiment, the injection port 160 extends through the second seal 106, at least partially in the axial direction.

Figure 2A:
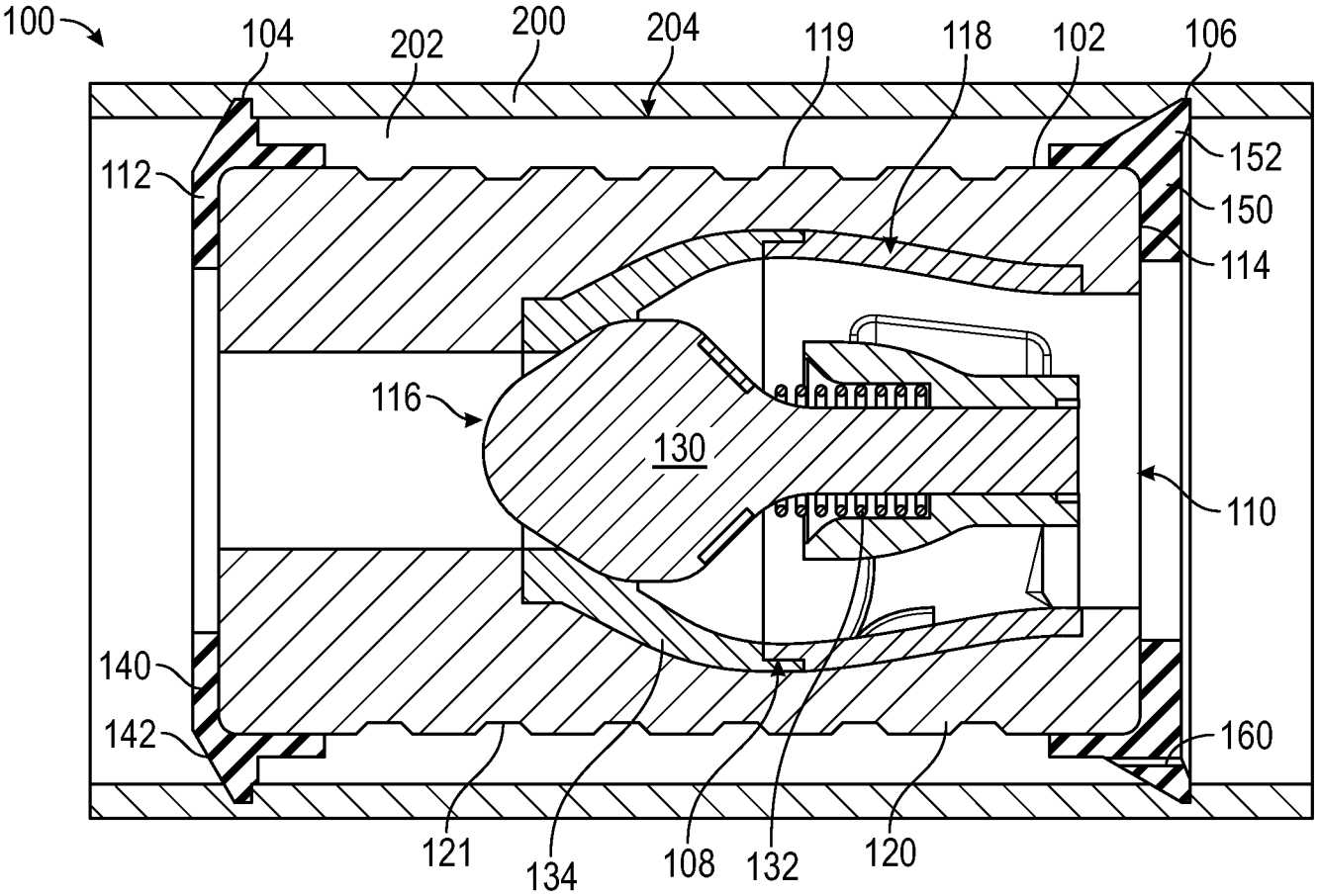
FIG. 2A illustrates a side, cross-sectional view of the downhole tool, according to an embodiment.

FIG. 2A illustrates a side, cross-sectional view of the downhole tool 100, according to an embodiment. In this embodiment, the body 102, seals 104, 106, and the float valve assembly 108 are positioned within a surrounding tubular 200. As shown, the seals 104, 106 engage an inner diameter surface 202 of the surrounding tubular 200. An annular region 204 may thus be defined radially between the outer diameter surface 119 of the body 102 and the inner diameter surface 202 of the surrounding tubular 200, and axially between the seals 104, 106.

Figure 2B:
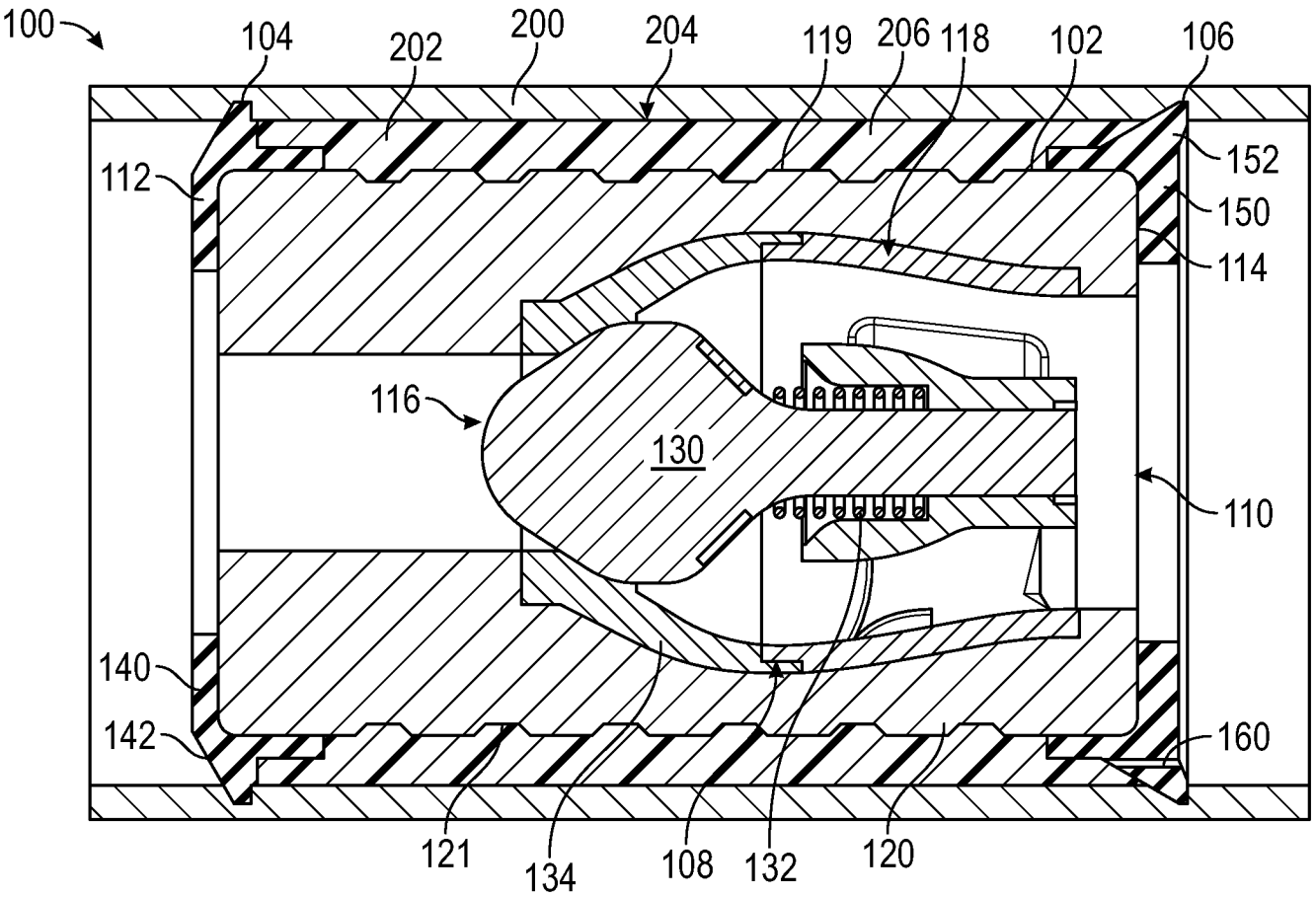
FIG. 2B illustrates a side, cross-sectional view of the downhole tool including a bonding agent that bonds a body of the downhole tool to a surrounding tubular, according to an embodiment.

As mentioned above, the injection port 160 extends through the first seal 104, in this embodiment, and thus communicates with the annular region 204. Accordingly, a bonding agent may be introduced through the injection port 160 and into the annular region 204. The bonding agent may be an epoxy. FIG. 2B illustrates the downhole tool 100 with a bonding agent 206 substantially or entirely filling the annular region 204. When cured, the bonding agent 206 may form an epoxy body that holds the body 102 in place within the surrounding tubular 200.

In an embodiment including the ridges 120 and grooves 121, as shown, the ridges 120 and grooves 121 may provide axially-facing surfaces that engage the bonding agent 206, thereby increasing the holding capability of the bonding agent 206 against axial forces. Furthermore, as mentioned above, the tapered portions 142, 152 of the seals 104, 106 may be configured to deflect. Such deflection may serve not only to accommodate surrounding tubulars 200 of different sizes, but also to allow gas within the annular region 204 to escape while the bonding agent 206 is injected and to provide an external indication when the annular region 204 is full, by allowing some of the bonding agent 206 to move therepast.

In some embodiments, the injection port 160 may, initially, be omitted. In such embodiments, the injection port 160 may be formed by a puncturing member (e.g., an injection needle) that pierces through one of the seals 104, 106. Once the puncturing member pierces through the seal 104 or 106, the bonding agent 206 may be fed therethrough. When the puncturing member is withdrawn, the injection port 160 may close. In addition, in some embodiments, evacuation ports may also be provided, e.g., in one or both of the seals 104, 106 to allow gas entrained within the annular region 204 to escape while the bonding agent 206 is fed therein.

Figure 3:
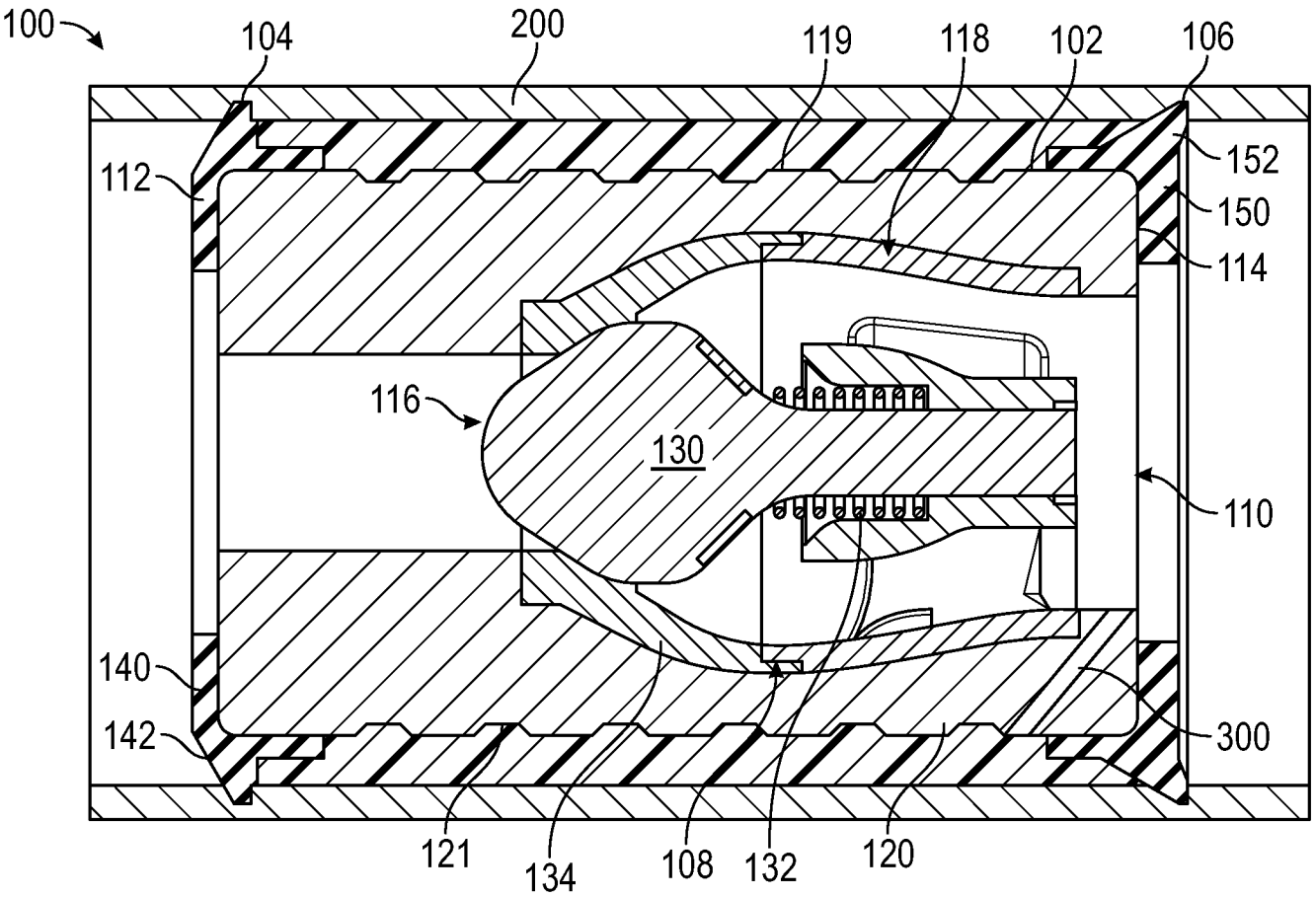
FIG. 3 illustrates a side, cross-sectional view of another embodiment of the downhole tool.

FIG. 3 illustrates another embodiment of the downhole tool 100, similar to the downhole tool 100 of FIGS. 2A and 2B, but with an injection port 300 extending through the body 102. The injection port 300 in the body 102 may serve the same function as the injection port 160 extending through the seal 104, allowing for communication with the annular region 204 and introduction of bonding agent 206 thereto.

Figure 4:
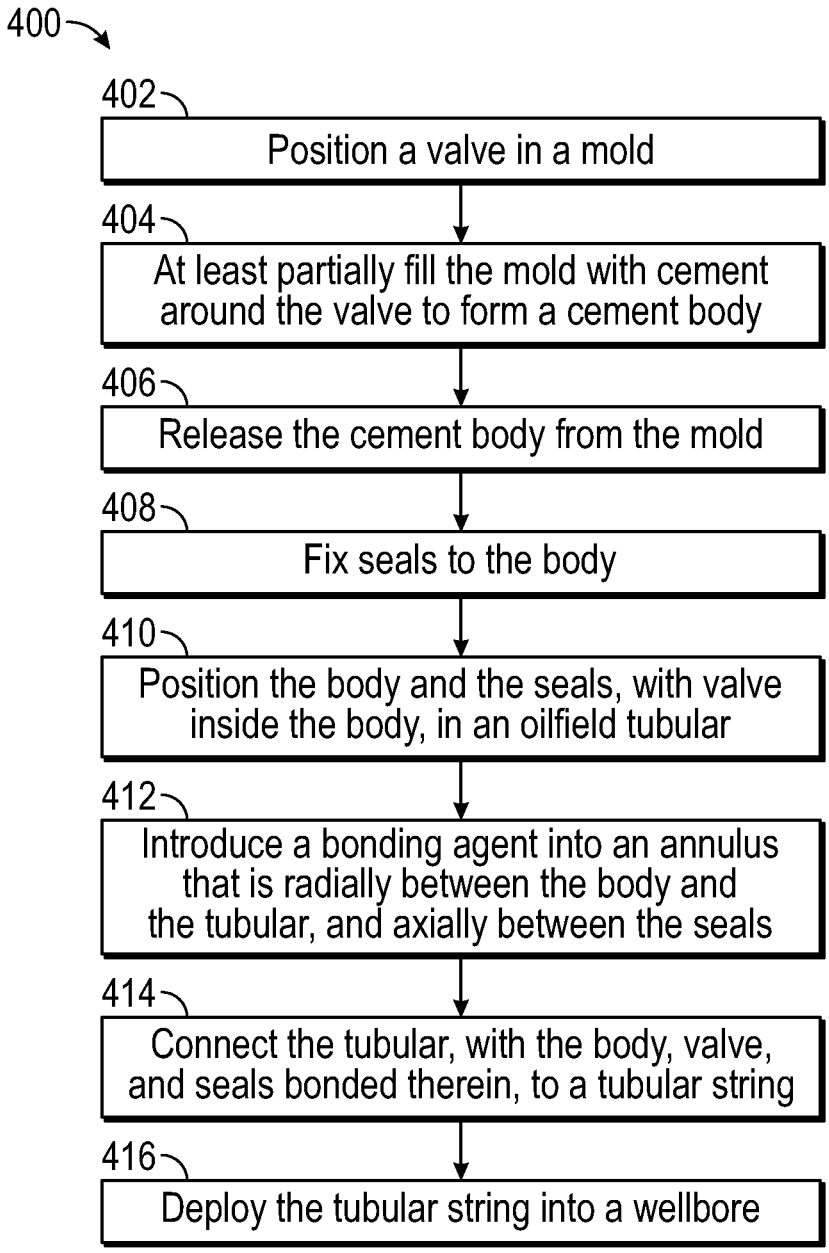
FIG. 4 illustrates a flowchart of a method for constructing a downhole tool, according to an embodiment.
Figure 5:
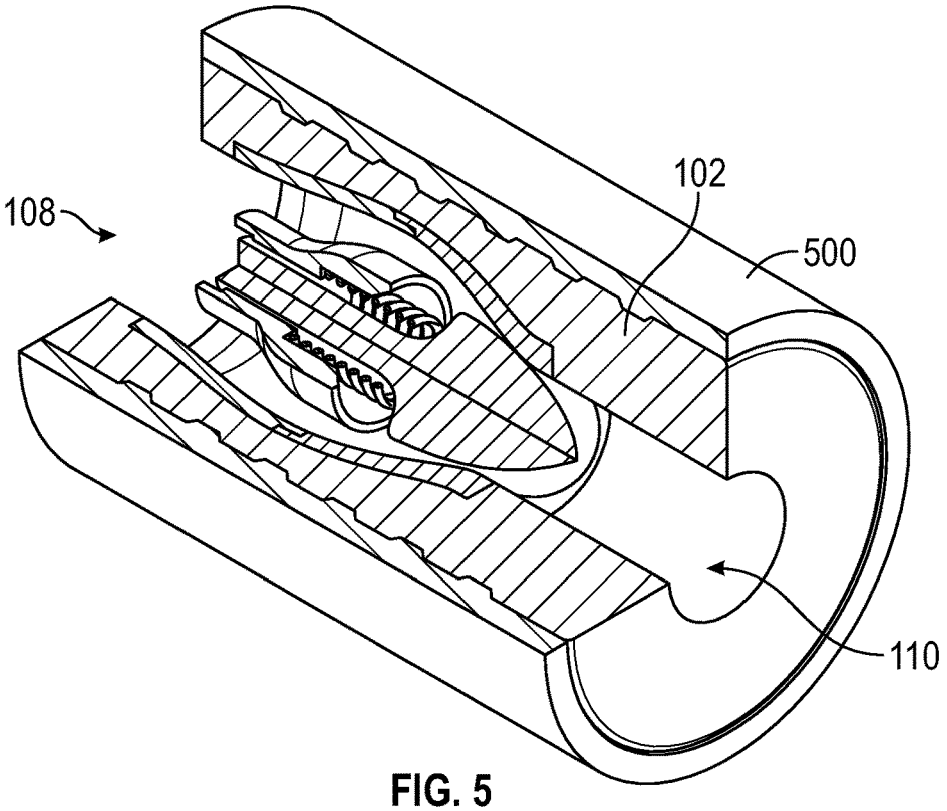
FIG. 5 illustrates a perspective view of a mold being filled with cement around a valve to form a body of the downhole tool, according to an embodiment.
Figure 6:
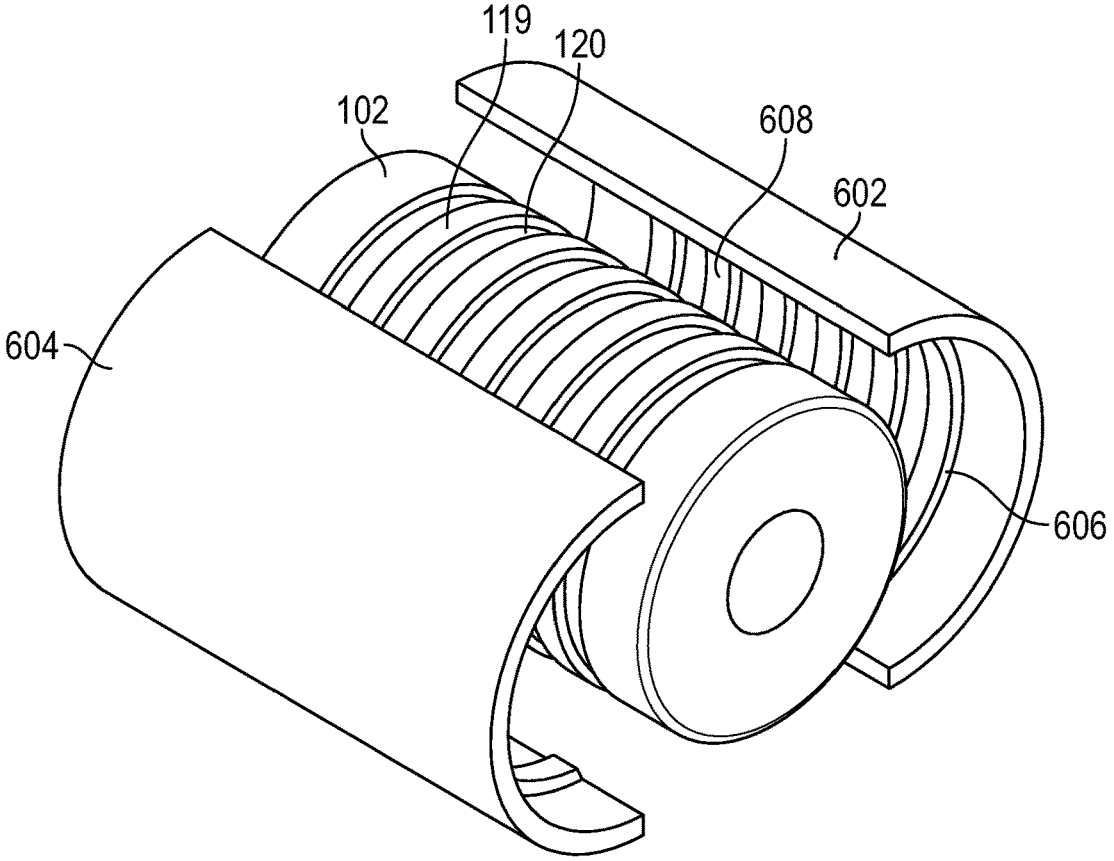
FIG. 6 illustrates a perspective view of the body releasing from the mold, according to an embodiment.
Figure 7:
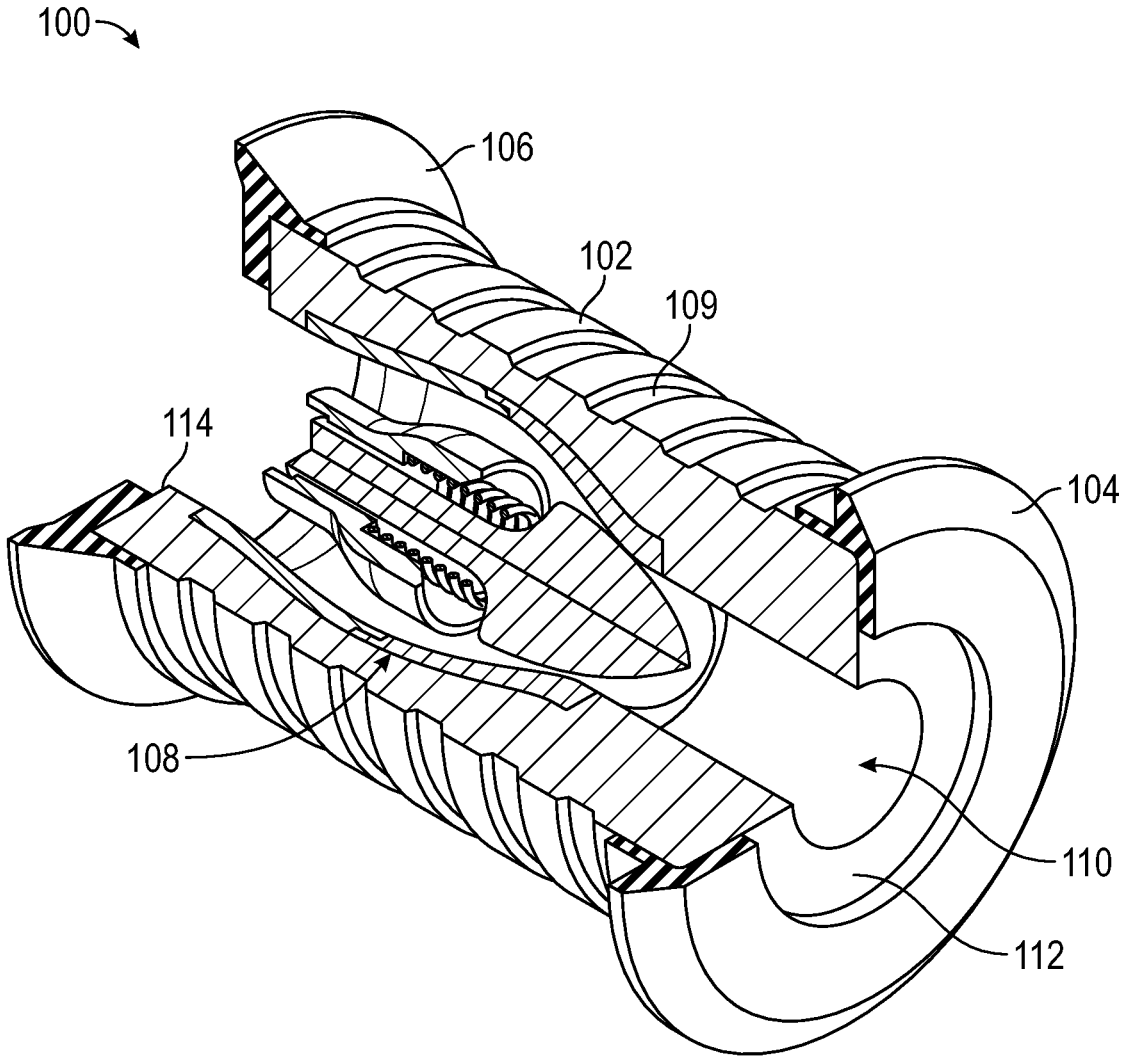
FIG. 7 illustrates a perspective view of seals being attached to the body, according to an embodiment.

FIG. 4 illustrates a flowchart of a method 400 for fabricating a downhole tool, according to an embodiment. Some of the stages of the method 400 are generally illustrated in FIGS. 5-7, each of which show at least a part of the downhole tool 100. The method 400 will thus be described herein with respect to the components of the downhole tool 100, with it being appreciated that this is merely an example.

Referring to FIGS. 4 and 5, the method 400 may begin, at 402, by positioning a valve (e.g., the valve assembly 108) in a mold 500. The mold 500 may then be at least partially filled with cement, around the valve assembly 108, as at 404. This may result in the formation of the body 102, at least partially from cement. A fixture may be employed to form the bore 110 away from the valve assembly 108.

The method 400 may then proceed to releasing the body 102 from the mold 500, as at 406. As shown in FIG. 6, the mold 500 may, for example, be made from two or more segments 602, 604 that may be separated to release the body 102. In other embodiments, the mold 500 may be otherwise configured to allow for release of the body 102, or may be consumable and destroyed to release the body 102. The mold 500 may define ridges 606 and grooves 608 therein, in some embodiments, which may produce a profile on the outer diameter surface 119 of the body 102, e.g., forming the ridges 120 and grooves 121 as complements to the grooves 608 and the ridges 606.

Next, and as shown in FIG. 7, the seals 104, 106 may be fixed to the body 102, as at 408. In one example, the seals 104, 106 may be bonded to the body 102, and axially offset from one another, e.g., positioned on opposite axial ends 112, 114 of the body 102. For example, the seals 104, 106 may be bonded to the outer diameter surface 119 of the body 102.

The method 400 may then proceed to positioning the body 102, having the first and second seals 104, 106 fixed thereto, in an inside diameter of an oilfield tubular (e.g., the tubular 200 of FIGS. 2A and 2B), as at 410. This may result in the annular region 204 being defined radially between the cement body 102 and the oilfield tubular 200 and axially between the first and second seals 104, 106. In at least one embodiment, positioning the body 102 and seals 104, 106 (e.g., and valve assembly 108 within the body 102) within the tubular 200 may proceed by sliding the body 102, with the first end 112 preceding the second end 114, into the tubular 200 (although the ordering of the first and second ends 112, 114 may be reversed). During this procedure, the seals 104, 106 may deflect by engagement with the tubular 200, and form at least a partial seal therewith. The degree to which the seals 104, 106 deflect may be a function of the inside diameter of the tubular 200. As such, the body 102 and seals 104, 106 may be configured to be employed with tubulars 200 having a range of inside diameters.

The method 400 may then proceed to introducing a bonding agent 206 into the annular region 204, as at 412. As explained above, this may proceed via the injection port 160 and/or 300 and/or by piercing one of the seals 104, 106 using an injection needle. Furthermore, the introduction of the bonding agent 206 may continue until the annular region 204 is substantially or totally filled, which may be indicated when the bonding agent 206 begins to deflect and move past one or both seals 104, 106. The bonding agent 206 may then be left to cure, as at 414, thereby securing the body 102, seals 104, 106, and valve assembly 108 within the tubular 200.

The oilfield tubular 200, into which the body 102, seals 104, 106, and valve assembly 108 are received and secured, may be pre-threaded according to the specifications of the tubular string of which it will form a part. Accordingly, the method 400 may then proceed to connecting the tubular 200 to the string, as at 416, and deploying the string into a well, as at 418.

Figure 8:
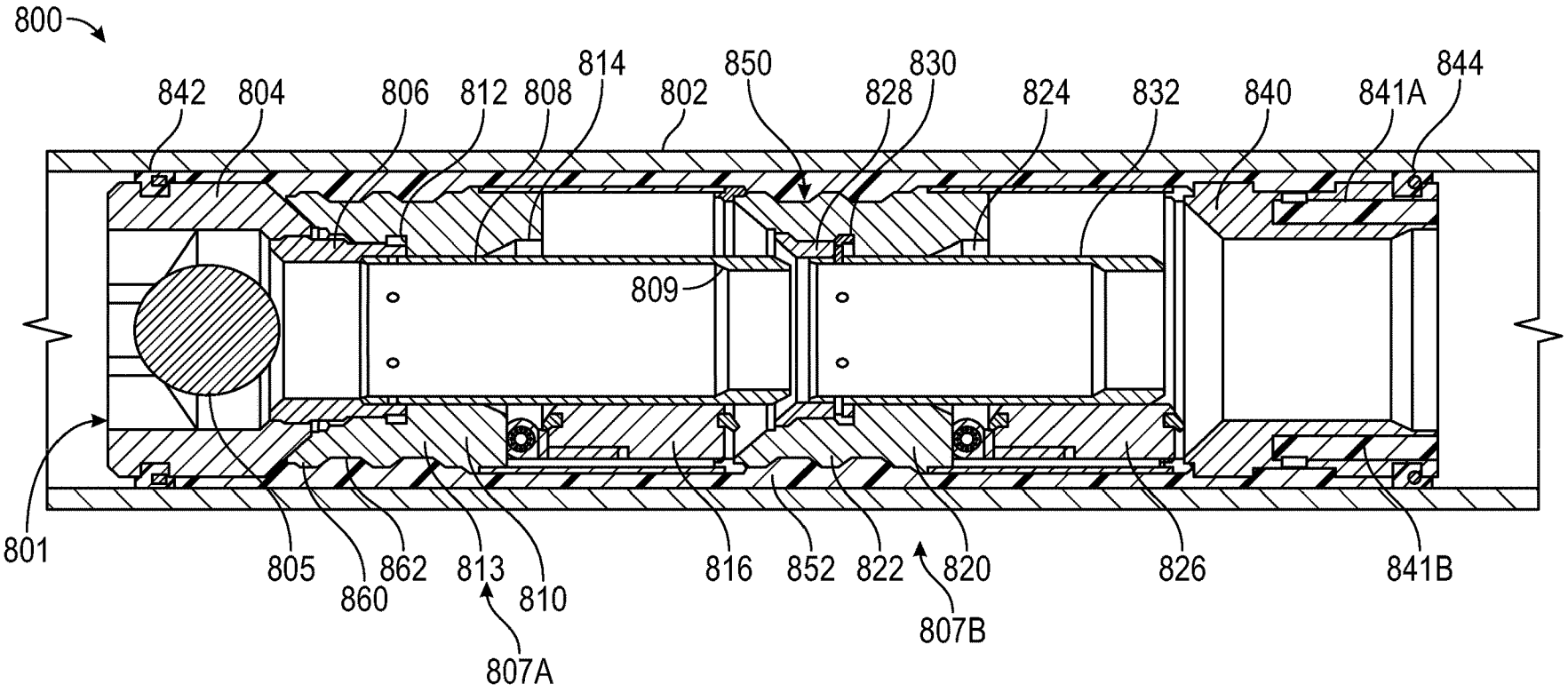
FIG. 8 illustrates a cross-sectional side view of another downhole tool, according to an embodiment.

FIG. 8 illustrates a side, cross-sectional view of another downhole tool 800, according to an embodiment. The tool 800 may include a tubular 802, which may be connected to a string of tubulars, e.g., on one or both axial ends via an integral threaded connection, a coupling, or the like. The tool 800 also includes an inner valve assembly 801 positioned in the tubular 802. The inner valve assembly 801 may be configured to provide one-way flow through the tubular 802, similar to the float valve assembly 108 discussed above. In this embodiment, however, the inner valve assembly 801 may provide a flapper valve, which may be selectively actuated via increasing pressure in a well.

For example, the inner valve assembly 801 may include an upper sub 804 positioned at an upper (e.g., "uphole") end thereof. In at least some embodiments, the upper sub 804 is a ball cage. In other embodiments, the upper sub 804 may be configured to contain other types of obstructing members, or may be empty or provide a different function. An obstruction member 805, e.g., a ball, may be positioned in the upper sub 804, and prevented from exiting the tool 800 in an uphole direction, e.g., by a bar, plate, ported plug, or the like disposed in the upper sub 804 for this purpose.

The inner valve assembly 801 may also include one or more valves, e.g., a first valve 807A and a second valve 807B. The first valve 807A may include a first retainer sub 806, which may include a bore sized to permit the obstruction member 805 to proceed therethrough. A first sleeve 808 is connected to the first retainer sub 806, and includes a bore, which may be profiled so as to catch the obstruction member 805, e.g., at a shoulder 809 therein. As such, the obstruction member 805 may be prevented from proceeding through the lower end of the sleeve 808. The connection between the first retainer sub 806 and the first sleeve 808 may be shearable, e.g., designed to yield under a predetermined load, so as to release the first sleeve 808 from the first retainer sub 806 when such load is applied thereto. For example, shear studs, shear pins, shear screws, or shear threads may be employed to make the shearable connection. The first retainer sub 806 may also be coupled to a first valve housing 810 and to the upper sub 804, e.g., in a manner not meant to shear at the predetermined load. For example, an end of the first retainer sub 806 may be received onto a shoulder 812 formed in the first valve housing 810. The upper sub 804 may also be connected to the first valve housing 810 and/or the first retainer sub 806, as shown.

The first valve housing 810 may include a base 813 in which the shoulder 812 is defined, a valve seat 814 disposed at a downhole side of the base 813, and a flapper valve element 816 that is pivotally coupled to the base 813. In an embodiment, the flapper valve element 816 may be biased, e.g., with a torsion spring, to pivot toward and into engagement with the valve seat 814, which may prevent flow of fluid through the tool 800 in an uphole direction (to the left in this view). As shown in FIG. 8, the first sleeve 808, when connected to the first retainer sub 806, may extend through the base 813 and may block the pivoting movement of the flapper valve element 816, thereby preventing the flapper valve element 816 from pivoting to a closed position in engagement with the valve seat 814 from the illustrated open position.

The second valve 807B may include a second valve housing 820, which may be coupled to the first valve housing 810. The second valve housing 820 may be generally similar to the first valve housing 810, and may include a base 822, a valve seat 824, and a flapper valve element 826. Further, a second retainer sub 828 may be received into and engaged against a shoulder 830 formed in the base 822. The second retainer sub 828 may be shearably coupled to a second sleeve 834, which extends through the second valve housing 820 and prevents the flapper valve element 826 from pivoting to a closed position in engagement with the valve seat 824. A lower end of the first sleeve 808 may extend partially into the second retainer sub 828 and may be configured to engage the second sleeve 834 in order to actuate the inner valve assembly 801 and permit the first and second valves 807A, 807B to close.

The second valve 807B may be provided for redundancy, and thus, in some embodiments, the second valve 807B may be omitted. In other embodiments, three or more valves may be provided in series, e.g., to ensure further that the inner valve assembly 801 is operable downhole. In still other embodiments, the second valve housing 820 may be included, but a single sleeve (e.g., sleeve 808) may extend through both the second valve housing 820 and the first valve housing 810 (and/or other valve housings, if provided).

In some embodiments, the inner valve assembly 801 may also include a lower sub 840 that is connected to the lower-most valve housing, in this case, the second valve housing 820, and, as such, in this embodiment, the second valve 807B is interposed between the lower sub 840 and the first valve 807A. The lower sub 840 may include two or more ports 841A, 841B, which may serve as injection ports. Further, in the illustrated embodiment, two outer seals are provided, a first or "upper" seal 842 positioned radially between the upper sub 804 and the tubular 802, and a second or "lower" seal 844 positioned radially between the lower sub 840 and the tubular 802. As shown, the first seal 842 may be directly connected to the upper sub 804 and the second seal 844 may be directly connected to the lower sub 840. The seals 842, 844 are thus axially separated apart by the length of the first and second valve housings 810, 820 (and/or other valve housings, if provided), as well as a portion of the lower sub 840 and the upper sub 804. The seals 842, 844 may deflect against or otherwise seal with the tubular 802, similar to the seals 104, 106 discussed above.

An annular region 850 may be defined axially between the first and second seals 842, 844 and radially between at least a portion of inner valve assembly 801 and the tubular 802. The ports 841A, 841B may be configured to provide fluid communication from a lower end of the lower sub 840 to the annular region 850, above the lower seal 844. Thus, the annular region 850 may be filled with a flowable bonding agent, such as epoxy via the injection ports 841A, 841B defined in the lower sub 840. The epoxy may serve to fill not only the annular region 850, but may also at least partially fill the injection ports 841A, 841B. Once cured, the epoxy may form an outer body 852 that secures the inner valve assembly 801 in the tubular 802. In at least some embodiments, the first and/or second valve housings 810, 820, may include ridges 860 and/or grooves 862, as shown, extending radially and providing additional load surfaces for securing the inner valve assembly 801 in the tubular 802.

The downhole tool 800 may be inserted into and secured in the tubular 802, and then run into a well, as part of a tool string including tubulars connected to one or both axial ends of the tubular 802. The tool 800 may initially permit uphole-directed fluid flow, which may, for example, facilitate lowering of the tool 800 into the well. When desired to cutoff uphole-directed flow, a downhole-directed flow may be provided, e.g., via one or more pumps. The obstruction member 805 may be responsive to this downhole-directed flow, which may press the obstruction member 805 against the first sleeve 808. As pressure builds above the obstruction member 805, the load on the shearable connection between the first retainer sub 806 and the first sleeve 808 increases, until the first sleeve 808 shears away from the first retainer sub 806. The first sleeve 808 then slides into engagement with the second sleeve 832. The pressure buildup continues to apply a load thereto via the continued engagement between the obstruction member 805 and the first sleeve 808, which is transmitted by axial engagement to the second sleeve 832. The shearable connection between the second sleeve 832 and the second retainer sub 828 eventually yields, and the obstruction member 805, the first sleeve 808, and the second sleeve 832 may be ejected in a downhole direction from the tool 800. Once this occurs, the flapper valve elements 816, 826 are free to pivot toward the respective valve seats 814, 824, so as to prevent fluid flow through the tool 800 in an uphole direction, while permitting downhole-directed fluid flow. Again, it is emphasized that other types of tools, valves, etc. may be employed instead of or in addition to the one-way, flapper valve arrangement discussed herein.

Figure 9:
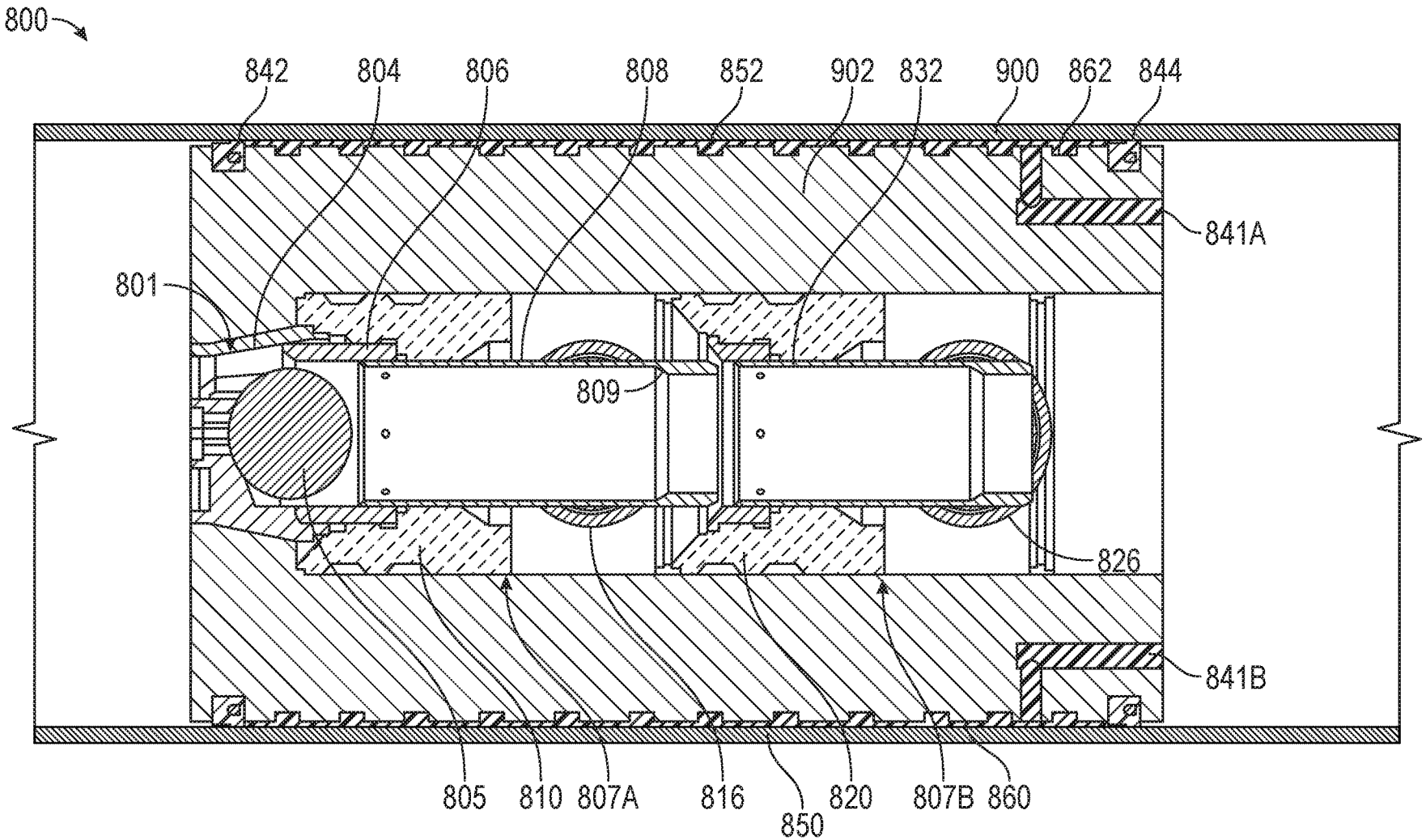
FIG. 9 illustrates a cross-sectional side view of another downhole tool, according to an embodiment.

The tubular 802, discussed above, may be of a generally small diameter, permitting the inner valve assembly 801 to be secured directly therein by the epoxy body 852. In some embodiments, however, the tubular may be relatively large in diameter as compared to the inner valve assembly 801. FIG. 9 illustrates an example of such an embodiment, in which the tool 800 includes a larger-diameter tubular 900.

Accordingly, the body 852 is formed from the bonding agent, as discussed above, and an intermediate body 902 is also provided. The intermediate body 902 may be formed on the inner valve assembly 801 and is radially between the inner valve assembly 801 and the tubular 900. The intermediate body 902 may be made at least partially from a castable material, such as cement, and may be formed generally as discussed above. Further, the outer diameter of the intermediate body 902 may define the annular region 850 with the tubular 900, and thus the seals 842, 844 may be positioned around and directly coupled to the intermediate body 902 (rather than the inner valve assembly 801) at either axial end thereof, with the ridges 860 and grooves 862 optionally formed on the exterior of the intermediate body 902. Thus, the inner valve assembly 801 is positioned within a bore formed in the intermediate body 902. Further, the ports 841A, 841B may be formed in the intermediate body 902, permitting fluid communication between a position below the intermediate body 902 and the annular region 850. It will be appreciated that the ports 841A, 841B may extend from an upper axial end surface of the intermediate body 902, rather than the lower axial end surface. In other embodiments, ports may be provided on both axial ends of the tool 800. Moreover, the lower sub 840 may be omitted from this embodiment.

Further, the outer body 858 may be formed by injecting the bonding agent (e.g., epoxy) thereof through the ports 841A and/or 841B formed in the intermediate body 902. Accordingly, the outer body 858 may still be radially between the tubular 900 and the inner valve assembly 801, but the intermediate body 902 may extend radially therebetween. Thus, the outer body 858 may directly secure the intermediate body 902 to the tubular 900, while the intermediate body 902 is directly secured to the inner valve assembly 801.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a tubular;

an inner valve assembly positioned in the tubular;

a body positioned radially between the inner valve assembly and the tubular, the body at least partially made from a bonding agent configured to secure the inner valve assembly in the tubular; and one or more injection ports formed in the inner valve assembly, the body, or both, wherein the one or more injection ports are configured to receive the bonding agent and channel the bonding agent to an annular region radially between the inner valve assembly and the tubular.

2. The downhole tool of claim 1, further comprising a first seal and a second seal that are separated axially apart and are positioned radially between the inner valve assembly and the tubular, the first and second seals engaging the tubular, wherein the body is at least partially axially between the first and second seals.

3. The downhole tool of claim 2, wherein neither the first seal nor the second seal is penetrated to permit injection of the bonding agent into the annular region.

4. The downhole tool of claim 2, wherein the inner valve assembly comprises:

a first valve;

an upper sub coupled to the first valve; and a lower sub coupled to the first valve, wherein the first seal is coupled to the upper sub and the second seal is coupled to the lower sub.

5. The downhole tool of claim 4, further comprising a second valve interposed between the lower sub and the first valve.

6. The downhole tool of claim 4, wherein the lower sub comprises one or more ports in communication with an end of the lower sub and with an annular region formed axially between the first and second seals, wherein the one or more ports are configured to receive the bonding agent of the body therethrough and to channel the bonding agent into the annular region.

7. The downhole tool of claim 2, wherein the body comprises an intermediate body and an outer body, the outer body comprising the bonding agent, and the intermediate body comprising a cast material, the first and second seals being coupled directly to the intermediate body and not directly to the inner valve assembly, and the outer body being formed axially between the first and second seals and radially between the tubular and the intermediate body.

8. The downhole tool of claim 7, wherein the intermediate body comprises one or more ports formed therein, the one or more ports extending from an end of the intermediate body to an annular region formed radially between the intermediate body and the tubular and axially between the first and second seals, and wherein the one or more ports are configured to receive the bonding agent and to channel the bonding agent to the annular region to form the outer body.

9. The downhole tool of claim 7, wherein the intermediate body comprises cement that is formed on an outside of the inner valve assembly.

10. The downhole tool of claim 7, wherein the intermediate body comprises one or more grooves, one or more ridges, or both configured to provide a loading surface for engagement with the outer body.

11. The downhole tool of claim 1, wherein the inner valve assembly comprises:

an obstruction member; and a sleeve preventing the inner valve assembly from actuating from an open position to a closed position, wherein the obstruction member is configured to press against the sleeve in response to a fluid pressure, so as to eject the sleeve from the inner valve assembly and permit the inner valve assembly to close.

12. The downhole tool of claim 11, wherein the inner valve assembly comprises a ball cage configured to prevent the obstruction member from being displaced in at least one direction from within the inner valve assembly.

13. The downhole tool of claim 11, wherein the inner valve assembly comprises a flapper valve element that is obstructed from pivoting toward a valve seat by the sleeve.

14. The downhole tool of claim 1, wherein the inner valve assembly comprises one or more ridges, one or more grooves, or both for connection to the body.

15. The downhole tool of claim 1, wherein the inner valve assembly comprises a float valve.

16. A method, comprising:

casting an intermediate body onto an inner valve assembly;

positioning the inner valve assembly in a tubular, wherein an annular region is formed radially between the intermediate body and the tubular;

injecting a bonding agent through one or more ports formed in the intermediate body into the annular region formed radially between the inner valve assembly and the tubular, to form an outer body that secures the inner valve assembly in the tubular, wherein the intermediate body is radially between the inner valve assembly and the outer body;

connecting the tubular to a string of oilfield tubulars; and deploying the inner valve assembly, the tubular, and the string into a well.

17. The method of claim 16, wherein the annular region is sealed by a first seal and a second seal that are coupled directly to the intermediate body and not directly to the inner valve assembly, the first and second seals engaging the tubular.

18. The method of claim 16, wherein injecting the bonding agent comprises injecting the bonding agent through one or more ports formed in a lower sub of the inner valve assembly, and wherein the annular region is sealed by a first seal and a second seal, the first seal being connected to an upper sub of the inner valve assembly and the second seal being connected to the lower sub, and wherein the first and second seals engage the tubular.

19. The method of claim 16, further comprising increasing a pressure in the well, wherein increasing the pressure in the well causes an obstructing member to eject a sleeve from within the inner valve assembly, and wherein ejecting the sleeve allows the inner valve assembly to actuate from an open position to a closed position.

20. A downhole tool, comprising:

a tubular;

an inner valve assembly positioned in the tubular, wherein the inner valve assembly comprises:

a first valve;

an upper sub coupled to the first valve; and a lower sub coupled to the first valve; and a body positioned radially between the inner valve assembly and the tubular, the body at least partially made from a bonding agent configured to secure the inner valve assembly in the tubular, wherein the lower sub comprises one or more ports in communication with an end of the lower sub and with an annular region formed radially between the inner valve assembly and the tubular, wherein the one or more ports are configured to receive the bonding agent of the body therethrough and to channel the bonding agent into the annular region.

21. A downhole tool, comprising:

a tubular;

an inner valve assembly positioned in the tubular;

a body positioned radially between the inner valve assembly and the tubular, the body configured to secure the inner valve assembly in the tubular, wherein the body comprises an intermediate body and an outer body, the outer body comprising the bonding agent, and the intermediate body comprising a cast material; and a first seal and a second seal that are separated axially apart and are positioned radially between the inner valve assembly and the tubular, the first and second seals engaging the tubular, wherein the first and second seals are coupled directly to the intermediate body and not directly to the inner valve assembly, wherein the outer body being is formed axially between the first and second seals and radially between the tubular and the intermediate body, wherein the intermediate body comprises one or more ports formed therein, the one or more ports extending from an end of the intermediate body to an annular region formed radially between the intermediate body and the tubular and axially between the first and second seals, and wherein the one or more ports are configured to receive the bonding agent and to channel the bonding agent to the annular region to form the outer body.

22. A method, comprising:

positioning an inner valve assembly in a tubular;

injecting a bonding agent through one or more ports formed in a lower sub of the inner valve assembly into an annular region formed radially between the inner valve assembly and the tubular, to form an outer body that secures the inner valve assembly in the tubular, wherein the annular region is sealed by a first seal and a second seal, the first seal being connected to an upper sub of the inner valve assembly and the second seal being connected to the lower sub, and wherein the first and second seals engage the tubular;

connecting the tubular to a string of oilfield tubulars; and deploying the inner valve assembly, the tubular, and the string into a well.

* * * * *